US005887730A

United States Patent [19]

St. George

[11] Patent Number: 5,887,730

[45] Date of Patent: Mar. 30, 1999

[54] EASILY-INSTALLED QUICK-RELEASE LOCKING MODULAR EXPANDABLE LONG GUN RACK WITH OPTIONAL ADAPTERS TO HOLD HANDGUNS

[75] Inventor: Charles St. George, Medford, Oreg.

[73] Assignee: U.S. Orininal, Inc., Oreg.

[21] Appl. No.: 818,496

[22] Filed: Mar. 14, 1997

[51] Int. Cl.[6] ..... A47F 7/00

[52] U.S. Cl. ..... 211/4; 211/64

[58] Field of Search ..... 211/4, 64, 60.1, 211/70.6; 70/58

[56] References Cited

U.S. PATENT DOCUMENTS

| | | | |
|---|---|---|---|
| 3,618,785 | 11/1971 | Newman | 211/4 |
| 3,857,491 | 12/1974 | Townsend et al. | 211/8 |
| 4,139,100 | 2/1979 | Reed | 211/4 |
| 4,624,372 | 11/1986 | Brolin | 211/4 |
| 4,696,405 | 9/1987 | Waring | 211/4 |

*Primary Examiner*—Alvin C. Chin-Shue
*Assistant Examiner*—Sarah Purol
*Attorney, Agent, or Firm*—Fuess & Davidenas

[57] ABSTRACT

A first assembly mounted to an external wall engages and holds a first end portion of a long gun between (i) a shackle having ends terminating in a stud portion and (ii) an elongate hollow housing with apertures accepting the shackle's stud portions. A slide member slides within the interior of the hollow housing to engage the stud portion of the shackle, normally in a keyhole-shaped hole. A key lock retains the slide in its position engaging the stud end portions of the shackle. A similarly-appearing second assembly, mounted to the wall in spaced-parallel relationship to the first assembly, has shackles with threaded ends that are permanently mounted to a second hollow housing by nuts. A long gun is slid under a permanent shackle of the second assembly, and shackled under a removable and locking shackle of the first assembly, in order to be securely, but visibly, held and retained.

11 Claims, 7 Drawing Sheets

EASILY-INSTALLED QUICK-RELEASE LOCKING MODULAR EXPANDABLE LONG GUN RACK WITH OPTIONAL ADAPTERS TO HOLD HANDGUNS

BACKGROUND OF THE INVENTION

1. Field of the Invention

The present invention generally concerns devices for the storage of firearms, and more specifically relates to a rack apparatus designed to be mounted to a wall or similar object to securely retain and prevent unauthorized removal of one or more firearms secured in the apparatus.

The present invention particularly concerns gun racks that are any of (i) economical of construction, (ii) strong and secure in the protection of firearms, (iii) easily and readily access, (iv) artistic and aesthetic to display held guns, (iv) variably configured upon installation to hold varying numbers of firearms of various sizes, and (v) versatile to hold both long guns and handguns at the same time.

2. Background of the Invention

It is desirable for both individuals and organizations to maintain and store firearms under some form of locking device in order to provide security against unauthorized use or theft of the firearms. It is particularly desirable that firearms stored in the home should not be accessible to an intruder lest they be turned against the homeowner. Wheresoever firearms are stored, the storage device should present maximum feasible resistance to theft of the firearms.

Firearm racks and cabinets are generally locking, but are typically made of wood and offer but little security against access to the stored weapons by brute force. Many gun racks or cabinets are but loosely attached to a wall or similar object, making that the entire rack or cabinet may be taken for later removal of the contained firearms.

Many various forms of firearm racks, cabinets and security methods appear within the prior art. Much of this art is concerned with a semi-secure display of the firearms rather than the typically greater security that is realized by storage of the firearms out of sight in vault-like containers. Generally, the prior art uses racks to store firearms for two reasons: the first being to protect the firearm by providing a relatively soft containment housing, and the second being for aesthetic values because, generally, the firearms are on display.

For example, U.S. Pat. No. 2,752,046 to Levy for a VERTICAL TYPE GUN RACK shows a gun rack using wood as its structural element. Levy teaches the display of the gun mounted in his apparatus and discloses a locking circular bar that passes across the stock of each gun in order to restrain the guns within the rack from unauthorized use. The rack is partitioned into sections with each section holding an individual gun. The locking circular bar is controlled by a sliding drawer under the gun rack such that, when the drawer is closed and locked, the bar is latched in place. Close examination of the disclosure reveals that the locking mechanism requires that each gun stock have substantially the same dimensions, otherwise, it could be possible to remove a gun with the locking bar in place. For example, if a gun owner had a gun with a large stock and one with a small stock, the size of Levy's apparatus would be set by the gun with the large stock and the gun with the small stock could be slipped out of the locked rack. It would be possible to let the gun, with the small stock, set the size of the gun and physically enlarge one section to accept the gun with the larger stock; however, this would require substantial re-working of the grill rack.

U.S. Pat. No. 2,958,422 to Caloiero et al. discloses a VERTICAL GUN RACK that also uses wood as its structural element. Caloiero, et al. use a locking bar which passes across the stock of each gun to restrain, from unauthorized use, the guns within the rack. Unlike Levy, Caloiero does not use sections with the gun rack, but uses slots in the base of the rack to accept the gun stock and openings in the top of the rack to accept the gun barrel. Caloiero requires that all contained guns have approximately the same dimensions near that point at which the locking bar passes in front of the guns; otherwise, it would be possible to slip a smaller gun up and past the locking bar.

U.S. Pat. No. 4,113,107 to Jaeger discloses a MACHINE GUN RACK that is most likely fashioned from metal although the structure could be made from wood. The machine gun rack is partitioned into sections with each section designed to hold a similar machine gun; thus, the disclosure teaches a device for use with similar sized guns. Jaeger uses two locking bars, one across the top of the gun and one which runs through each trigger guard on each contained gun. The lower bar, running through each trigger guard, limits this gun rack to only contain guns specifically suited to fit the rack; otherwise, a non-standard gun would interfere with the locking mechanism or not be properly secured from unauthorized use. There is no doubt that this apparatus provides excellent protection for the contained firearms, but the cost of such a device would be beyond the means of the ordinary gun owner.

U.S. Pat. No. 4,132,315 to Young discloses a SECURITY RACK FOR WEAPONS that is fashioned from metal and designed to secure variable length weapons. The apparatus resolves a number of problems found in the art, but is a complex device. The gun is held in place within the gun rack by an adjustable butt housing and the gun is secured by a tongue which closes across an upper slotted gun restraint thus providing a locking restraint. Because the device is complex, the cost will be high and will again be beyond the means of the ordinary gun owner.

U.S. Pat. No. 4,174,042 to Fair discloses a GUN LOCKING DEVICE fashioned from a combination of materials that is also designed to secure variable length guns. The apparatus, like that of Young, resolves a number of prior art deficiencies, but, also like Young, is somewhat complex. The restrained gun fits in a butt slot within the rack and has an upper slidable section that moves downward to grip the end of the protruding barrel. The slidable section can be locked in place by a sliding lever which is, in turn, locked in place by a padlock.

U.S. Pat. No. 4,461,385 to Clouser discloses LOCKING GUN RACKS, fashioned mainly of wood, which are seemingly inexpensive while providing reasonable security for the firearms contained. The wooden racks are designed to be bolted against a wall so that the complete rack cannot readily be moved. The same retaining bolts also constrain a chain that is designed to be passed through the trigger guard on each gun within the rack. The chain is then padlocked in place. The Clouser device is inexpensive, but being made of wood, can readily be forced open. The wall attachment bolts can be reached by the potential thief by simply using a saw to cut through or around a wooden plug which protects, or hides, the bolt head. All that is required to remove a gun (or all guns) is to remove one or the other attachment bolt which then releases the security chain. The padlock or chain can readily be cut by bolt cutters.

There is yet another problem with many prior art gun racks other than the defeat of their security function, per see.

Law enforcement officials recount firearm robbery attempts where, long guns being securely retained at their trigger guards, the long guns have simply be levered against this restraint, seriously damaging the guns while often, depending upon the strength of the securement mechanism, failing to even dislodge them. The gun owner is thus faced with the spectacle of his or her valuable firearms not just robbed—where presumably someone, somewhere, would get some use from them—but wantonly destroyed. It is therefore desirable that a firearm security system should not only keep the firearms from being stolen, but should also prevent them from being destroyed by being worked against the system restraints by callous and ignorant thieves and vandals.

Finally, many owners of long guns, both rifles and shot guns, store their guns in soft carrying cases. These cases afford a certain degree of protection for the contained gun in that the case will keep dust, grit, moisture and the like away from the gun. Very often the gun owner will have some guns in soft cases and other guns without cases that need to be secured. This means that a variable sized firearm (with or without soft case) needs to be stored in a gun rack. The prior art cannot readily meet this requirement.

Thus, there exists a need for a simple, inexpensive and readily adjustable gun rack device that can securely rack guns of varying sizes with or without soft cases: a device that will severely curtail both the theft and/or the wanton destruction of racked guns, but that can easily be opened or locked; a device that can store both long rifles and handguns interchangeably; a device that places the secured firearms on display in an effective and aesthetic manner; and a device that operates safely and securely and without damage to all manner of the firearms that it serves to secure.

SUMMARY OF THE INVENTION

The present invention contemplates a gun rack that is economical of construction, strong and secure in the protection of firearms, easily and readily accessed with a proper key, artistic and aesthetic to display guns without obscuration, variably configured upon installation to hold varying numbers of firearms of various sizes, and versatile to hold long guns and pistols or revolvers at the same time.

In accordance with the present invention, a first assembly is mounted to an external wall for engaging and for holding a first end portion of a long gun. This first assembly includes a first-type shackle having two ends at least a one end of which, and normally both ends of which, terminates in a stud portion. The first assembly further includes an elongate hollow first housing having and defining apertures, normally some number of arrayed pairs of such apertures, that are suitable to accept the two ends of at least one first-type shackle, and more typically two or three or more shackles depending upon how many guns are to be racked. A slide is slidingly mounted in the interior of the hollow first housing for sliding along the elongate length thereof. The slide has a catch mechanism, preferably a number of arrayed apertures at least one of which, and normally all of which, exhibits a size gradient. The slide's catch mechanism is suitable to selectively engage and release the stud portion of the first-type shackle, normally by action so simple as grabbing the stud portion of a shackle in a narrow region of one of the graduated-size apertures as the slide is slid within the first housing.

The first assembly normally (but not invariably) further includes a locking mechanism, normally a key lock, for retaining the slide in its position engaging the at least one stud end of the first-type shackle, therein selectively engaging the first-type shackle to the first housing.

The first assembly including the housing, slide and shackles is thus effective to selectively engage, and to release, the at least one stud end of the first-type shackle, therein selectively engaging, and releasing, the first-type shackle from the first housing and selectively engaging, and releasing a first end portion of a long gun that is retained between the shackle and the housing.

There is, however, more still more to the present invention. A second assembly is preferably mounted to the external wall in spaced-parallel relationship to the first assembly. This second assembly serves to engage and to hold an opposite, second, end portion of the long gun—therein to rack and to secure the long gun to the wall at both of its ends.

The second assembly includes a second-type shackle that is substantially visually similarly appearing to the first-type shackle. The second-type shackle has two ends at least a one end of which, and normally both of which, terminates in an engagement feature, normally simple screw threads. The second assembly further includes an elongate housing second housing that is substantially visually similarly appearing to the first housing. This second housing has and defines apertures suitable to accept the two ends of at least one second-type shackle much as the first-type housing's apertures accepted the first-type shackle. A engagement mechanism, normally a simple machine nut, serves to permanently engage the at least one end, and normally both ends, of the second-type shackle terminating in the engagement feature—the screw threads—so as to permanently hold the second-type shackle to, and within the apertures of, the second housing.

In combined operation of the wall-mounted two assemblies in use of the gun rack, a first end portion of a long gun is slid between the second-type shackle and the second housing. The remaining, second-end, portion of the gun and is then placed under a first-type shackle before the first-type shackle is secured to the first housing by action of the sliding bar. The two shackles serve to engage, and to hold, the long gun to the spaced-parallel first and second assemblies.

There are still further niceties to the preferred embodiments of the invention. The housing of each of the first and the second assemblies have and present a securement mechanism, normally a simple screw plate, by wherein the housing is mountable to the external wall, normally by long strong screws. The screw plate and screws are selectively accessible, and obscured, in accordance that the shackles of either housing are respectively either not engaged, or engaged, to the housing. Accordingly, the access for mounting the two spaced-parallel assemblies of the gun rack to the wall may be substantially hidden, inaccessible, and secure, during use of the gun rack.

Still further in accordance with preferred embodiments of the invention each of the elongate first and second assemblies are delivered to the purchaser, and into the environment of use, at an arbitrary long length. Each assembly is simply cut to length, normally by a hack saw, in accordance with the number of shackles that are to be engaged, and the number of guns that are to be retained. The slide element of the elongate first housing is cut right along with the housing itself. Both assemblies are so economical of construction, normally of extruded metal, that it is no great lost to cut off a length which can, in any case, sometimes be adapted to form yet another, normally non-locking, gun rack.

Finally in accordance with preferred embodiments of the invention, a small piece, normally of nylon or plastic or the like, may be slipped over a shank of a first-type, releasable, shackle to permit that the shackle—which has always been capable of engaging a pistol or a revolver as well as a long gun—should stably hold a pistol or revolver so engaged at a proper angle, and in a fixed manner.

These and other aspects and attributes of the present invention will become increasingly clear upon reference to the following drawings and accompanying specification.

DESCRIPTION OF THE PREFERRED EMBODIMENT

Figure 1:
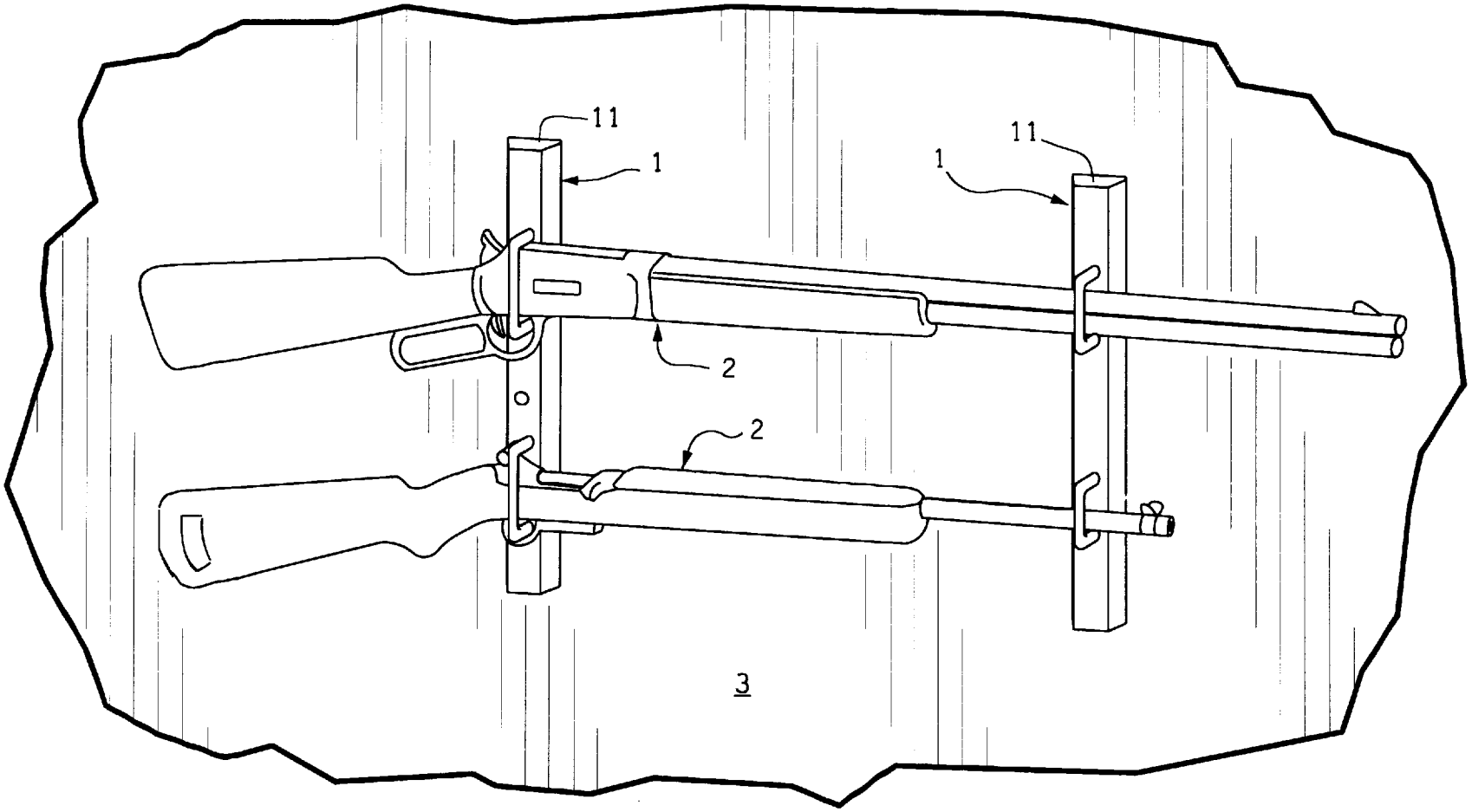
FIG. 1 is a diagrammatic perspective view showing a preferred embodiment of a gun rack in accordance with the present invention sized to hold two long guns and bolted to the studs in a wall in a typical deployment situation.

A preferred embodiment of gun rack system 1 in accordance with the present invention, configured at time of installation to hold and secure the illustrated two long guns 2 (shown in phantom line for not being part of the invention) is shown in FIG. 1. The system 1, consisting of a first assembly 11 and a second assembly 12, is typically bolted (by bolts_shown in Figure) typically to studs (not shown) that are typically in a wall 3 (not part of the invention).

Figure 2:
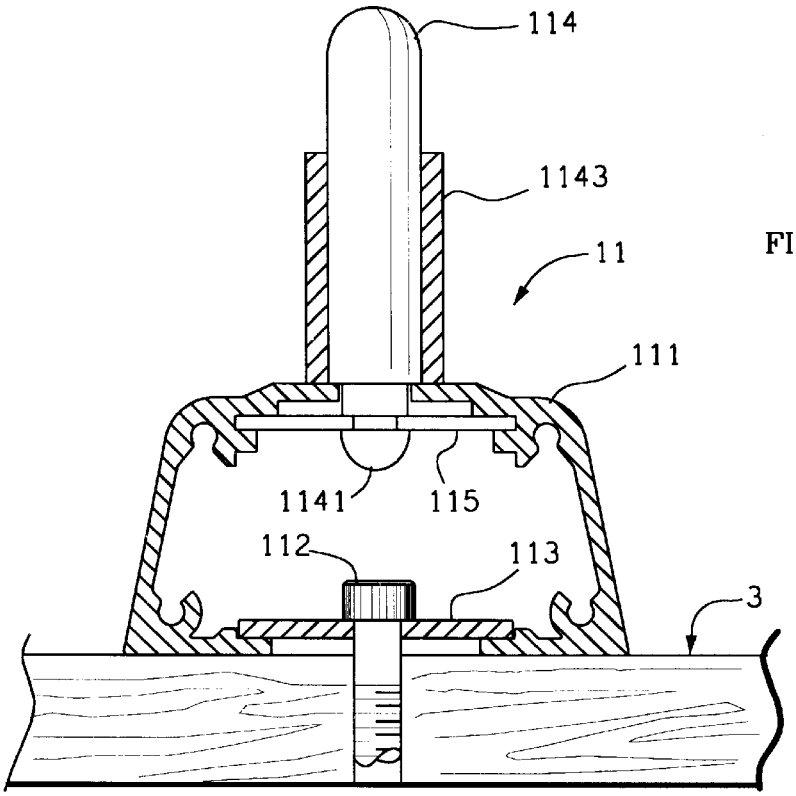
FIG. 2 is a cross-sectional end plan view of a first assembly, previously seen in FIG. 1, that has and supports removable shackles that permit selective capture of a mounted firearm.

A cross-sectional end plan view of the first assembly 11 of the preferred embodiment rack 1 is shown in FIG. 2, and a similar cross-sectional end plan view of the second assembly 12 of the preferred embodiment rack 1 is shown in FIG. 2. Each assembly 11, 12 has a corresponding housing, which are normally the same housing 111. Each housing 111 is typically strongly made from extruded metal, typically extruded aluminum. Each housing 111 has the same particular cross-sectional contour, as illustrated.

The housing 111 of the each of the first assembly 11 and the second assembly 12 is strongly secured to the wall 3 by a number of bolts 112 and washers 113 that are again common between the assemblies 11, 12. The bolts 112 are typically screw tipped lag bolts of a nominal length of four inches with, uncommonly for lag bolts, allen heads. The exterior circumference of the allen heads of the lag bolts 112 may be knurled, as illustrated, or may even be smooth for security purposes. The bolts 112 are sunk, normally into studs within the wall 3, under such extremely strong rotational forces as may be administered though their large size allen heads (or any similar head, such as a TORX type head), via shafted drive tools, normally an allen (or TORX) wrench that is fitted as the head of a socket-like element that is suitably engaged and driven by, typically, a ⅜" socket wrench. Being that such an allen-headed driver bit for a ⅜" socket is a well known, but relatively rare, tool, one such is typically supplied (in lieu of a standard allen wrench) with each gun rack system 1. Properly mounted to a ⅜" socket wrench (optionally extended), the allen-headed driver bit does a superb job of driving the lag bolts 112 deeply into the hardest woods. More importantly, the probability of a casual thief having this tool—even should access to the bolts 112 be obtained which, as will be explained, is difficult—is minuscule. Finally, and also importantly, if the gun rack system 1 is to be removed from the wall 3 after the lapse of some years or decades, then the required allen-headed driver bit can usually be purchased even if the original bit has been lost.

Allen head drive has been around for over one hundred years, and will likely be around for one hundred years more. The allen-headed bolts 112 are not readily subject to degradation or deterioration, including from inept turning during insertion or extraction, and are expected, along with other parts of the gun rack system 1, to last an indefinitely long period, at least fifty years.

The housing 111 of the first assembly 11 selectively mounts and retains a first-type shackle 114, while the housing 111 of the second assembly 12 permanently mounts and retains a second-type shackle 124. The first-type shackle 114 terminates in each of its legs in a stud portion 1141. The second-type shackle 124 terminates in each of its legs in an engagement feature 1241, normally screw threads (obscured in FIG. 3). The engagement features, or screw threads, 1241, of the second-type shackle 124 are engaged by, typically, a nut 1242, thereby permanently securing the second-type shackle 124 to the housing 111 of the second assembly 12.

Finally, in a portion of one of its legs the first-type shackle 114 slides into, and rotates within, a sleeve 1143. One end of this sleeve 1143 also compressively fits within a complimentary bore of the housing 111 of the first assembly 11. A slider 115 is present in the housing 111 of the first assembly 11; however no slider is used in the second assembly 12.

Figure 4A:
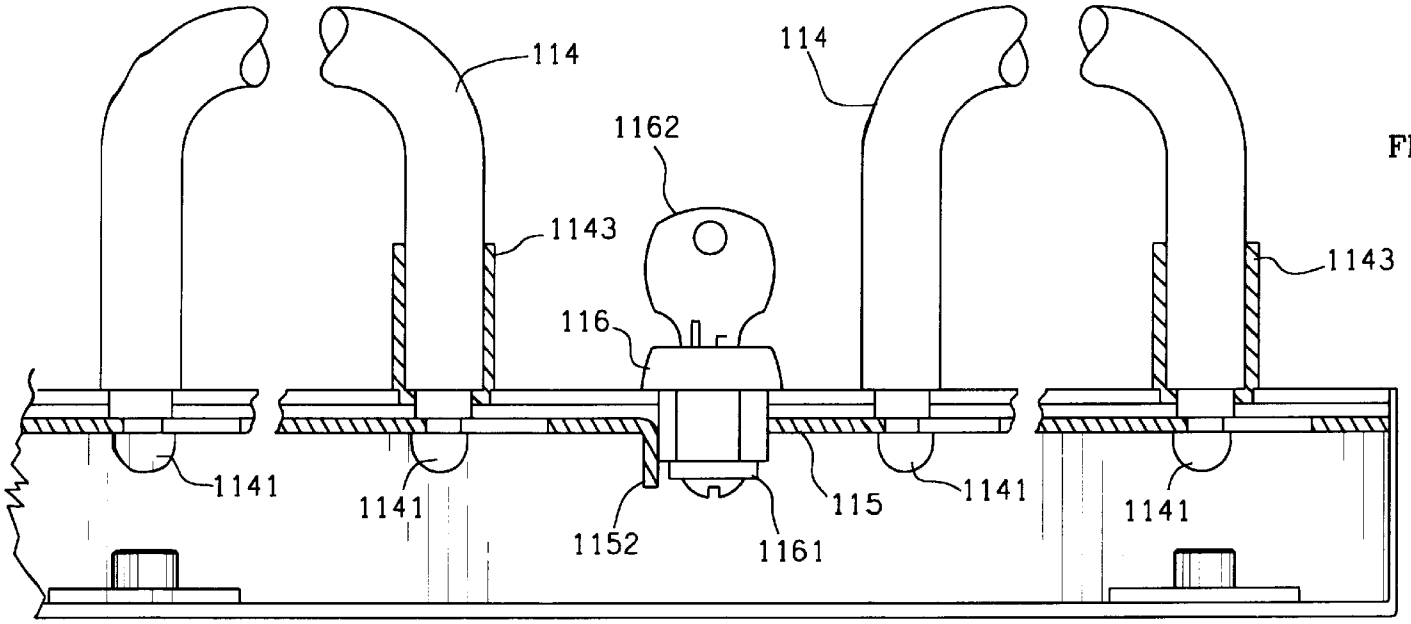
FIG. 4*a* is a cross-sectional side plan view of the first assembly, previously seen in FIGS. 1 and 2, with its removable shackles engaged by a sliding bar.
Figure 4B:
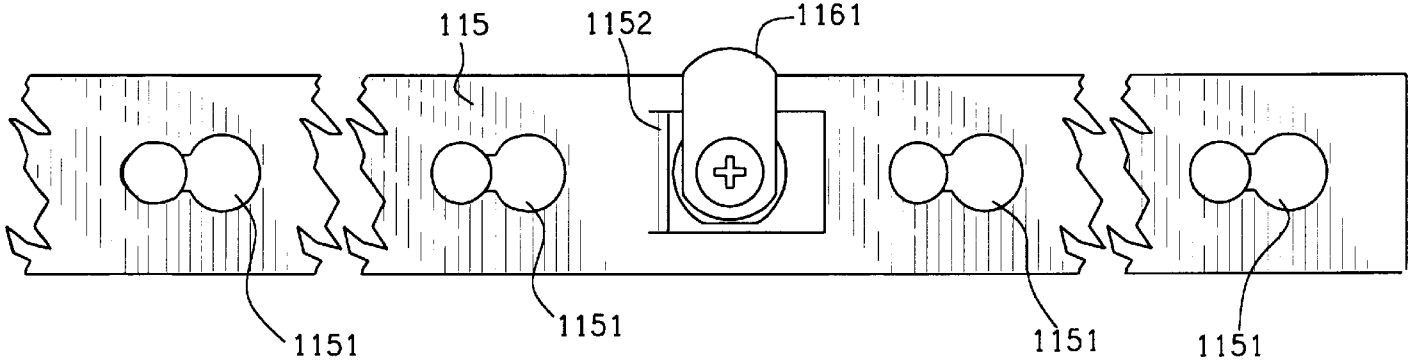
FIG. 4*b* is a cross-sectional top plan view of the sliding bar and lock, previously seen in FIG. 4*a*, in a first position serving to retain the removable shackles.
Figure 5A:
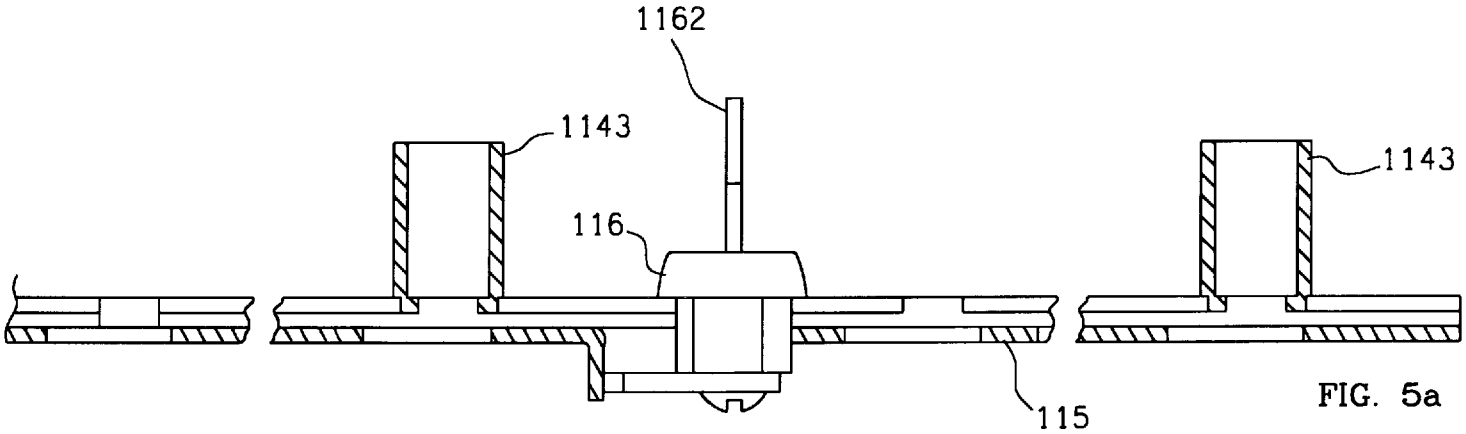
FIG. 5*a* is a cross-sectional side plan view of the first assembly, previously seen in FIGS. 1 and 2 and 4*a*, with its removable shackles released by a sliding bar.
Figure 5B:
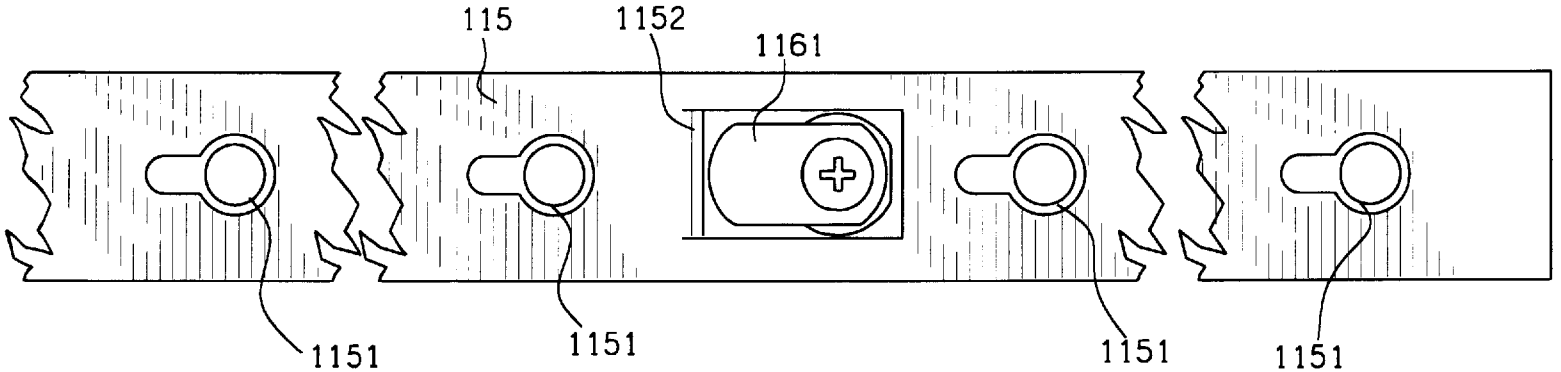
FIG. 5*b* is a cross-sectional top plan view of the sliding bar and lock, previously seen in FIG. 4*a* and 4*b* and 5*a*, in a second position serving to release the removable shackles.

Continuing in both FIG. 4 (consisting of FIGS. 4*a* and 4*b*) and FIG. 5 (consisting of FIGS. 5*a* and 5*b*), the operation of the slider 115 (and also a key lock 116) of the first assembly 11 to selectively engage, and disengage, a first-type shackle 114 may be considered. A least one end, and preferably both ends, of the first-type shackle 114 terminate in a stud portion 1141. These stud portions 1141 of the several shackles 114 fit within arrayed apertures of complimentary size and spacing within the top surface of the housing 111 to the first assembly 11. The slide 115 slides within the housing 111 to selectively engage and disengage, via a catch mechanisms, the stud portions 1141 of the first-type shackles 114. The catch mechanism of the side 115 is typically a number of arrayed apertures 1151 of a size and spacing related to the stud portions 1141 of the first-type shackles 114. Each of the arrayed apertures 1151 of the slide 115 is in fact graduated in size, exhibiting a size gradient along an imaginary longitudinal axis of the slide 115. The preferred shape of the arrayed apertures 1151 is a keyhole apertures, as is best illustrated in FIGS. 4*b* and 5*b*.

The sliding bar 115 is clearly capable of movement between a first position, illustrated in FIGS. 4*a* and 4*b*, where it serves to engage the stud portions 1141 of the first-type shackles 114, retaining the first-type shackles to the housing 111 of the first assembly 11, and a second position, illustrated in FIGS. 5*a* and 5*b*, where it serves to dis-engage the stud portions 1141 of the first-type shackles 114, releasing these first-type shackles 114 from the housing 111 of the first assembly 11.

The sliding bar 115 is so induced to sliding movement by a cam 1161 of a key lock 116. A key 1162 is inserted into the key lock 116 to turn the tumbler of the lock, rotating the cam 1161 against a bent protrusion 1152 of the slider 115. A rotation of 90 degrees permits the slider 116 to move to the shackle-release position shown in FIGS. 5*a* and 5*b*. This movement of the slider 115 by unlocking of the lock 116 by use of the key 1162 can be done with one hand, permitting the other hand to remove an firearm that has been retained (as illustrated in FIG. 1) under any first-type shackle 114.

Figure 6:
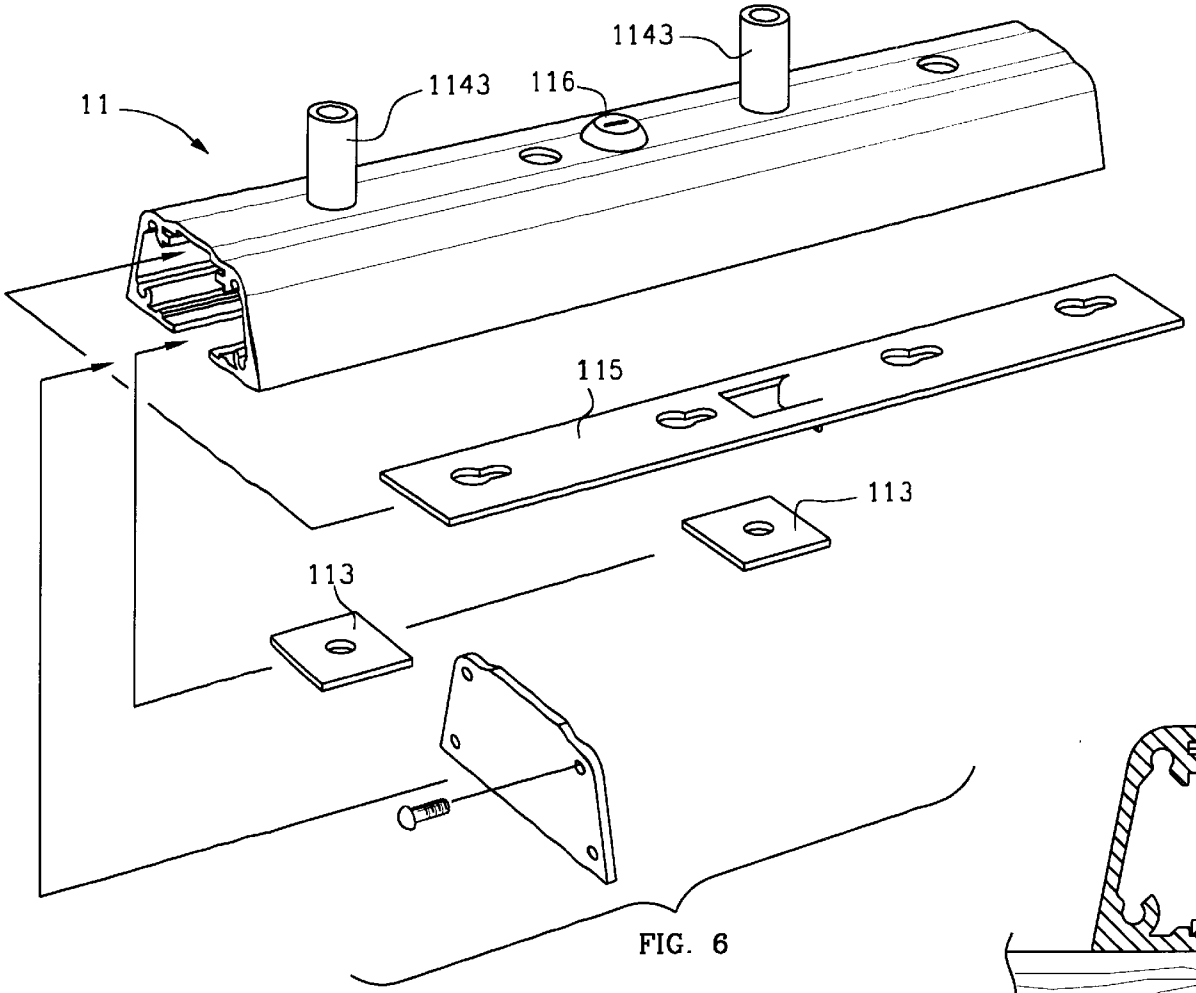
FIG. 6 is an exploded perspective view particularly showing the manner of mounting an assembly, in the illustrated case the first assembly, to a surface, normally to a wall.

An exploded perspective view of the manner of mounting an assembly, in the illustrated case the first assembly 11, to a surface, normally to a wall 3, is shown in FIG. 6.

Figure 7:
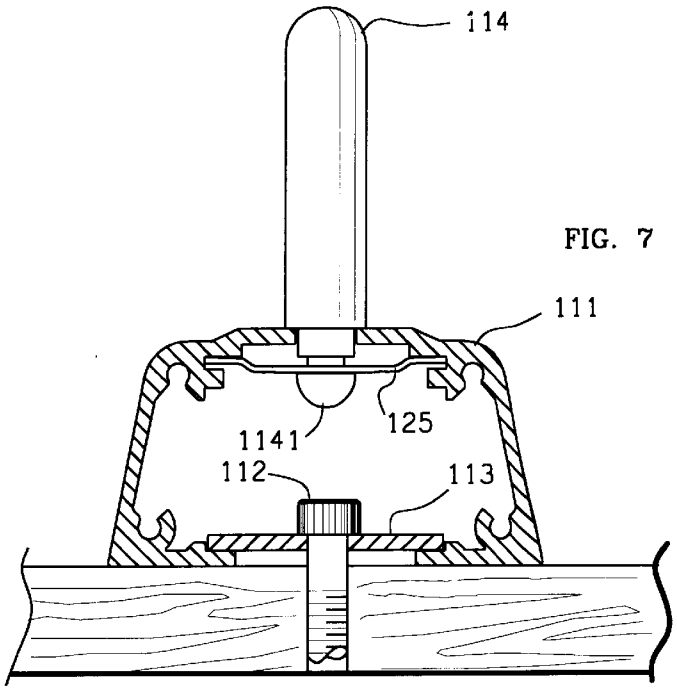
FIG. 7 is an end plan view showing both the location of the sliding bar within the housing of the first assembly, and also a typical bolt serving to mount the first assembly to a wall.

FIG. 7 is an end plan view showing both the location of the sliding bar within the housing 111 of the second assembly 12, a typical lag bolt 112 for mounting the housing 111 of the second assembly 12 to a wall 3, and, more importantly, an alternative affixation mechanism 125 permitting the first-type shackle 114 previously associated only with the first assembly 11 to now instead also be used with the second assembly 12. The alternative affixation mechanism 125 is preferably a simple apertured strip of spring steel into which the stud end portions 1141 of the first-type shackles 114 may be pushed and thereafter retained by spring force. This construction clearly permits that the first-type shackle 114 previously associated only with the first assembly 11 may now also be used with the second assembly 12.

Figure 8A:
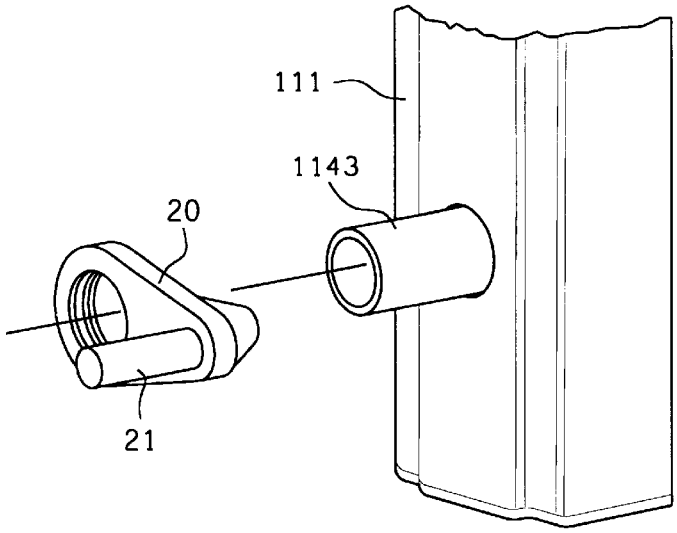
FIG. 8*a* is an exploded perspective view of a first embodiment of an optional added support member usable with the first assembly to hold handguns.
Figure 8B:
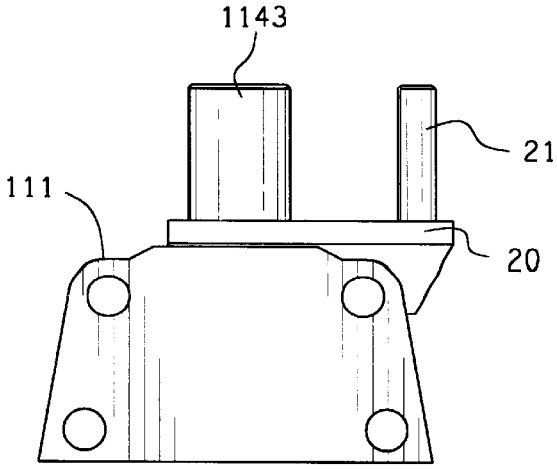
FIG. 8*b* is an end plan view of the first embodiment of the optional added support member for holding handguns previously seen in FIG. 8*a*.

An exploded perspective view of a first embodiment of an optional added support member 41 usable with the first assembly to hold handguns is shown in FIG. 8*a*, and an end plan view of this same embodiment is shown in FIG. 8*a*. FIG. 8 depicts the system adapted to lock up handguns by the simple addition of a handgun support member 20 which fits over the sleeve 4 and is so configured as to prevent its rotation about the axis of the sleeve by having a side portion that abuts the housing. The support member 20 is provided with a Pin 21 portion that supports the short barrels or sliders of various handgun styles. The member 20 can be fitted to allow the handguns to rest in the locked position in either direction in relation to the vertical housing.

Figure 10:
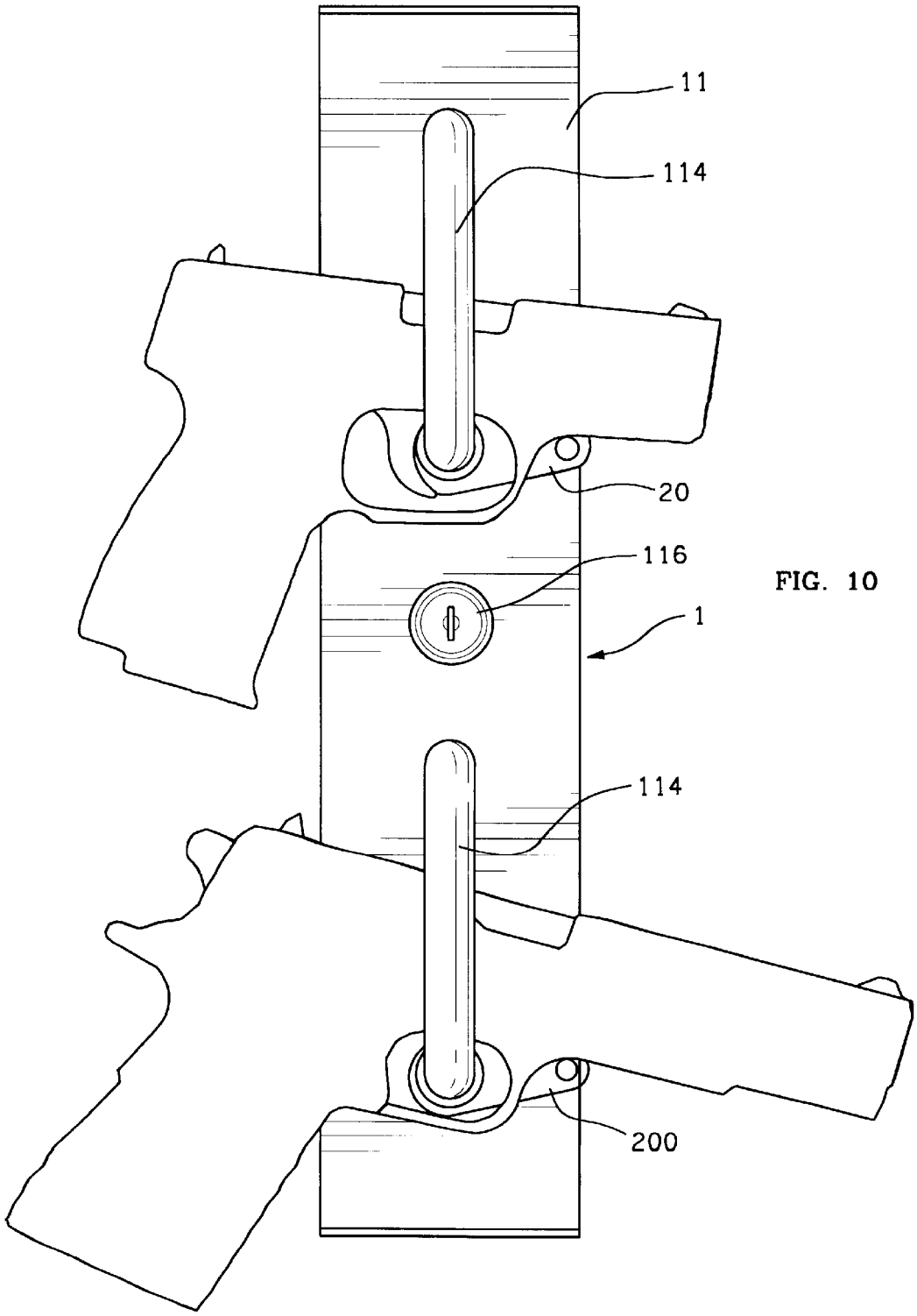
FIG. 10 is a diagrammatic top plan of either embodiment of the optional added support member in use with a first assembly to hold handguns.

FIG. 10 shows two handguns locked to the housing resting on the support member 20 as an example. The support member 20 is preferably injection molded out of Zytel super tough 14% glass filled and can be packed into the box, giving the end user the choice of weapons able of being locked up into the system.

Figure 9B:
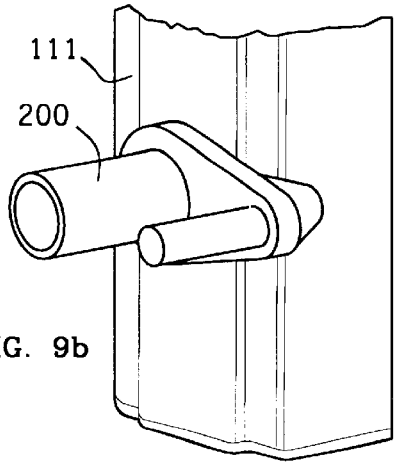
FIG. 9*b* is an end plan view of the side embodiment of the optional added support member for holding handguns previously seen in FIG. 9*a*.
Figure 9A:
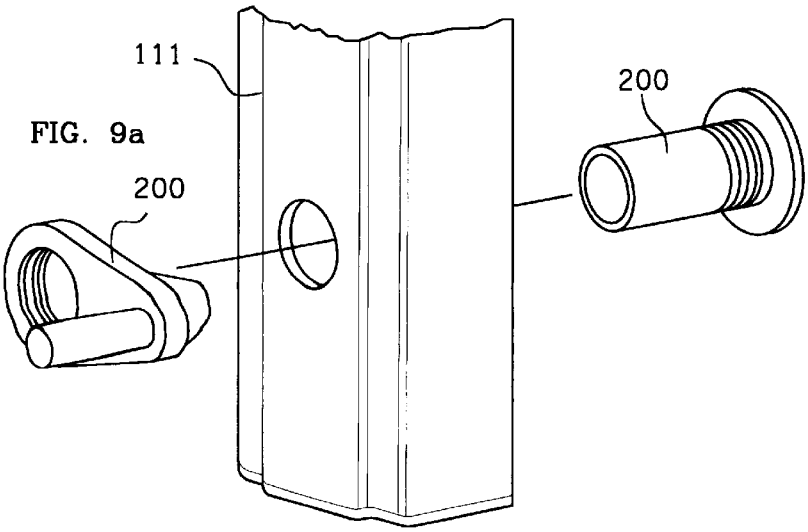
FIG. 9*a* is an exploded perspective view of a second embodiment of an optional added support member usable with the first assembly to hold handguns.

Similarly to the first embodiment member 20 seen in FIG. 8, an exploded perspective view of a second embodiment of an optional added support member 200 usable with the first assembly to hold handguns is shown in FIG. 9*a*, and an end plan view of this same embodiment is shown in FIG. 9*b*.

A diagrammatic top plan view of either embodiment 20, 200 of the optional added support member as is in use with a first assembly 11 to hold handguns 21 is shown in FIG. 10.

In operation of the rack system 1 of the present invention, a long gun is first slid under a permanent second-type shackle 124 of the housing 111 of the second assembly 12. A corresponding first-type shackle 114 of the housing 111 of the first assembly 11 being temporarily removed by action of the key lock 116 and the slider 115, the remaining end of the long gun is placed under this first-type shackle 114. The first-type shackle 114 is then reinserted into the housing 111 of the first assembly 11, and secured by action of the key lock 116 and the slider 115.

Both housings 111 of assemblies 11 and 12 are the same part made from an extruded shape, thereby serving to eliminate costly additional parts. The housings 11 are delivered into use in various generally long lengths that are adequate to mount approximately two or more shackles each for locking up a corresponding number of firearms. The housings 111 may, however, be "cut to length" normally with a hack saw. Any number of shackles—even so few as one—as serve to lock a corresponding number of firearms may be each for locking up a corresponding number of firearms may be used. Oppositely, very long lengths of the rack system 1, such as may be comprised of successive aligned segments, may be used to successively secure, locked segment by locked segment, large numbers of (typically vertically standing) firearms, as in gun store retail outlet applications.

The best method of manufacturing and fabricating the rack system 1 of the present invention in all its several various modes and lengths thus requires only minimum dedicated production tooling. In particular, the system 1 is designated to permit quick, easy and inexpensive fabrication without the need of welds.

In a multiple shackle system any individual firearms can be removed while, if desired, the remaining arms can be locked and secured. In addition the system 1 can be used on its own to lock up handguns without the any need to mount the system 1 onto a wall. Still further alternatively, the system 1 can be used to lock up both ends of a long arm, permitting the user to mount and to display his firearms in any orientation while securing any combination of long guns and or either handguns.

Figure 3:
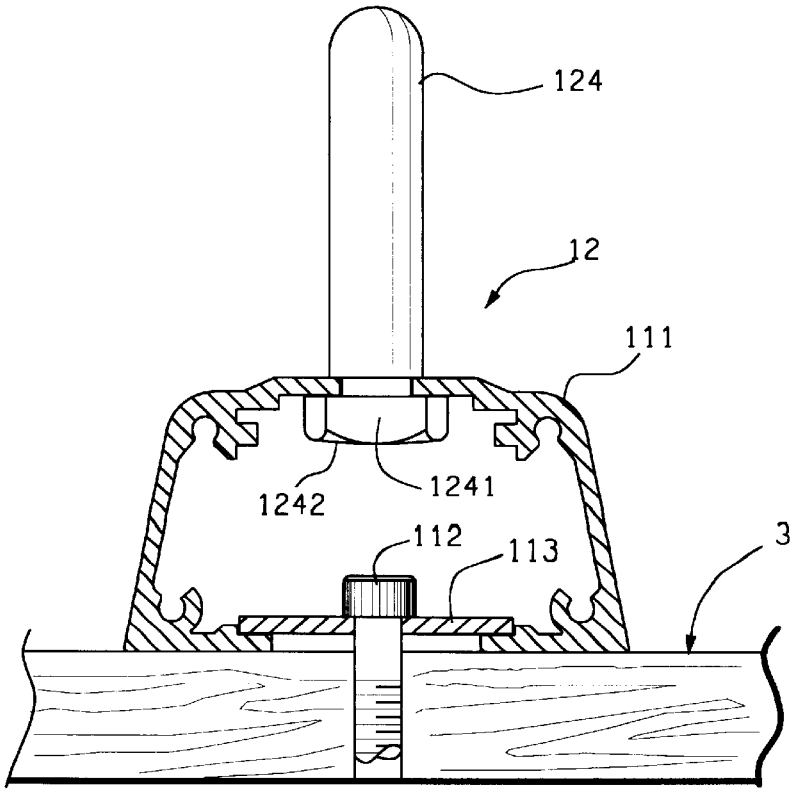
FIG. 3 is a cross-sectional end plan view of a second assembly, also previously seen in FIG. 1, that has permanent shackles under which shackles a portion of a firearm may be slid.

As should be considered when viewing FIG. 8, the mounting screws 12 (seen in FIGS. 2 and 3 are secured through the sleeves 4. FIGS. 8 though 10 show an adaptation of the rack system 1 to mount and to secure handguns, including both pistols and revolvers. A tube 14, which may be selectively threaded as illustrated in FIG. 9, extends to various distances from the housing 11. A retainer piece 129 having an extending post 121 fits about the tube 14. The retainer piece 129 is generally of complimentary contour to the juxtaposed surface of the housing 11, making that the retainer piece 129 will not easily rotate when secured tight to the housing 11 by seating of a shackle 114—as illustrated in FIG. 10. This non-rotation of the retainer piece 129 is not important to the security function of the system 1. It serves only so as to keep the displayed handguns at a predetermined orientation for aesthetic purposes. The retainer piece 129 and its extending post 121 are cooperatively interactive with the trigger guard of a secured handgun to secure the handgun, as is best illustrated in FIG. 10. The surfaces of the housing 11 and/or the retainer piece 129 can be flocked to protect the finish and surfaces of the firearms.

Accordingly, the retainer piece 129 will be perceived to be a handgun-antirotation piece that slides over a leg of a release shackle in order to help secure a handgun to the housing 11 alternatively to a long gun. Clearly this piece 129 has a body with an aperture that slips over a leg of the shackle, a region extending from the region of the aperture substantially perpendicularly to the a shackle leg that passes though the aperture, and two oppositely-extending protuberances in the extension region at a separation from the aperture. One protuberance clearly extends substantially parallel to the shackle leg towards the housing so as to, by contact with the housing, prevent the entire piece from rotating on the shackle leg. Meanwhile the other protuberance equally clearly extends oppositely so as to contact a portion of a handgun secured beneath the shackle alternatively to the long gun. A handgun is thus prevented from rotating about the leg of the shackle and relative to the housing 11.

Accordingly, and notably by use of the present invention, either a portion of a long gun, or a handgun, may be secured by a shackle 114 between itself and the housing 11. Moreover, the secured handgun is prevented from rotating by action of this handgun-antirotation piece in the form of retainer piece 129.

The retainer piece is preferably of unitary construction, and is preferably molded.

As yet another variant of the present invention, an electrically operated solenoid actuator can be substituted for the key lock. This electronic solenoid actuator is operated by remote control using a receiver and transmitter of known technology, similarly to the remote control security system of an automobile. This alternate releasing method can be used in applications to accomplish the locking and unlocking quickly in cases of urgency and to offer an alternate secure means other than mechanical keying. Furthermore, the remote control system can be interfaced with other electronic alarm systems that may be on the premises.

In accordance with the preceding explanation, variations and adaptations of the gun rack system in accordance with the present invention will suggest themselves to a practitioner of the mechanical arts.

In accordance with these and other possible variations and adaptations of the present invention, the scope of the invention should be determined in accordance with the following claims, only, and not solely in accordance with that embodiment within which the invention has been taught.

What is claimed is:

1. A gun rack comprising:

a first assembly, mountable to an external wall, for engaging and for holding an end portion of a long gun, the first assembly including a plurality of first-type shackles each having two ends at least one of which ends terminates in a stud portion, an elongate hollow first housing having and defining apertures suitable to accept the two ends of the plurality of first-type shackles, and a slide, slidingly mounted in an interior of the hollow first housing for sliding along the elongate length thereof, having a catch means suitable to selectively engage and release the stud portion of each of the plurality of first-type shackles;

wherein the slide is slidable within the first housing so that the catch means of the slide will selectively collectively engage, and release, the stud portions of each of the plurality of first-type shackles, therein selectively collectively engaging, and releasing, the plurality of first-type shackles from the first housing en masse.

2. The gun rack according to claim 1 wherein the first assembly's slide's catch means comprises:

a plurality of arrayed apertures, defined by the slide, each of which plurality of apertures exhibits a size gradient;

wherein the slide is slidable within the first housing so that its plurality of apertures of graduated size will selectively engage, and release, each of the stud portions of the plurality of first-type shackles, therein selectively engaging, and releasing, the plurality of first-type shackles from the first housing.

3. The gun rack according to claim 1 wherein the first assembly further includes:

locking means for retaining the slide in its position engaging the stud portions of the plurality of first-type shackles, therein selectively collectively engaging the plurality of first-type shackles to the first housing en masse.

4. A gun rack comprising:

a first assembly, mountable to an external wall, for engaging and for holding an end portion of a long gun, the first assembly including a plurality of first-type shackles each having two ends at least one of which ends terminates in a stud portion, an elongate hollow first housing having and defining apertures suitable to accept the two ends of the plurality of first-type shackles, and a slide, slidingly mounted in an interior of the hollow first housing for sliding along the elongate length thereof, having catch means suitable to selectively collectively engage and release the stud portions of each of the plurality of first-type shackles, wherein the slide is slidable within the first housing so that its catch means will selectively engage, and release, the stud portions of the plurality of first-type shackles, therein selectively collectively engaging, and releasing, the plurality of first-type shackles from the first housing en masse; and securement means for mounting the first housing of the first assembly to an external wall, the securement means being selectively accessible, and obscured, in accordance that the first-type shackle of the first assembly is respectively either not engaged, or is engaged, to the first housing of the first assembly by the slide of the first assembly.

5. The gun rack according to claim 1 wherein each of the first assembly's is delivered into the environment of use at an arbitrary long length, and is cut to length in both its elongate first housing and in its slide element so that a desired number of the apertures in the first housing are exposed, and so that a desired number of first-type shackles are selectively removably engaged therein, during use.

6. A gun rack comprising:

a first assembly, mountable to an external wall, for engaging and for holding an end portion of a long gun, the first assembly including a plurality of first-type shackles each having two ends where at least one end terminates in a stud portion, an elongate hollow first housing having and defining apertures suitable to accept the two ends of each of the plurality of first-type shackles, a slide, slidingly mounted in an interior of the hollow first housing for sliding along the elongate length thereof, having catch means suitable to selectively engage and release the stud portions of each of the plurality of first-type shackles;

wherein the slide is slidable within the first housing so that its catch means will selectively engage, and release, the stud portions of the plurality of first-type shackles, therein selectively collectively engaging, and releasing, the plurality of first-type shackles from the first housing en masse;

a second assembly, mountable to the external wall in spaced-parallel relationship to the first assembly, for engaging and for holding an opposite end portion of the long gun therein in order to rack and to secure the long gun to the wall, the second assembly including a plurality of second-type shackles, each substantially visually similarly appearing to a first-type shackle, each having two ends at least a one end of which terminates in an engagement feature;

an elongate housing second housing, substantially visually similarly appearing to the first housing, having and defining apertures suitable to accept the two ends of each of the plurality of second-type shackles, and engagement means for permanently engaging the engagement features of the plurality of second-type shackles so as to permanently hold the plurality of second-type shackles to, and within the apertures of, the second housing;

wherein when a first end portion of a long gun is slid between any one of the plurality of second-type shackles and the second housing, and is then placed under a corresponding one of the plurality of first-type shackles before the first-type shackle is secured to the first housing by action of the sliding bar, then the long gun becomes engaged, and held, to the spaced-parallel first and second assemblies.

7. The gun rack according to claim 6 wherein for each of the plurality of second assemblies the second-type shackle's engagement feature comprises:

screw threads; and wherein the engagement means comprises:

a nut for permanently engaging the at least one end of the second-type shackle terminating in the screw threads so as to permanently hold the second-type shackle to, and within the apertures of, the second housing.

8. A gun rack comprising:

an elongate housing mountable on one side to an external wall and having and defining on the other side two apertures suitable to accept the two ends of a shackle;

a shackle having two legs each having an end that fits within a respective one of the two apertures of the elongate housing so as to selectively engage and hold an end portion of a long gun captured in position between (i) the shackle and (ii) the elongate housing:

lock means for selectively engaging and releasing the shackle from the elongate housing, therein to respectively capture and release an end portion of a long gun which is selectively captured and secured by the shackle in position between the shackle and the elongate housing;

a handgun-antirotation piece that slides over a leg of a released shackle in order to help secure a handgun to the assembly alternatively to the long gun, the piece having a body with an aperture that slips over a leg of the shackle, a region extending from the region of the aperture substantially perpendicularly to the a shackle leg that passes though the aperture, two oppositely-extending protuberances in the extension region at a separation from the aperture, one protuberance extending substantially parallel to the shackle leg towards the housing so as to, by contact with the housing, prevent the entire piece from rotating on the shackle leg while the other protuberance extends oppositely so as to contact a portion of a handgun secured beneath the shackle alternatively to the long gun, therein preventing the handgun from rotating about the leg of the shackle and relative to the housing;

wherein the either a portion of a long gun, or a handgun, may be secured by the shackle between the shackle and the housing;

wherein if and when a handgun is secured it is prevented from rotating by the handgun-antirotation piece.

9. The gun rack according to claim 8 wherein the handgun-antirotation piece is unitary.

10. The gun rack according to claim 8 wherein the handgun-antirotation piece is molded.

11. The gun rack according to claim 6 wherein the first assembly is delivered into the environment of use at an arbitrary long length, and is cut to length in both its elongate first housing and in its slide element so that a desired number of the apertures in the first housing are exposed, and so that a desired number of first-type shackles are selectively removably engaged therein, during use; and wherein the second assembly is also delivered into the same environment of use at an arbitrary long length, and is cut to length in its elongate second housing so that a desired number of the apertures in the second housing are exposed, and so that a desired number of second-type shackles are permanently engaged therein during use.

* * * * *